US009309790B2

(12) United States Patent
Hoppe et al.

(10) Patent No.: US 9,309,790 B2
(45) Date of Patent: Apr. 12, 2016

(54) HOUSING BELL WITH INTEGRATED PRESSURE ACCUMULATOR HAVING A FLANGED COVER

(75) Inventors: Jens Hoppe, Erlangen (DE); Ali Bayrakdar, Roethenbach/Pegnitz (DE); Marco Meisborn, Hoechstadt a.d. Aisch (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 37 days.

(21) Appl. No.: 14/113,420

(22) PCT Filed: Feb. 24, 2012

(86) PCT No.: PCT/EP2012/053161

§ 371 (c)(1),
(2), (4) Date: Oct. 23, 2013

(87) PCT Pub. No.: WO2012/167958

PCT Pub. Date: Dec. 13, 2012

(65) Prior Publication Data

US 2014/0048027 A1 Feb. 20, 2014

(30) Foreign Application Priority Data

Jun. 7, 2011 (DE) ..... 10 2011 077 027

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/047* (2013.01); *F01L 1/46* (2013.01); *F01L 2001/34446* (2013.01); *Y10T 29/49826* (2015.01)

(58) Field of Classification Search
CPC ..... F15B 2201/31; F15B 1/04; F15B 1/24; F01L 2001/34486; F01L 2001/3443; F01L 2001/34426; F01L 2001/34446; F01L 1/3442; F01L 2001/34433; F01L 2001/34493; F01L 2001/34496; F01L 2001/0475
See application file for complete search history.

(56) References Cited

U.S. PATENT DOCUMENTS 4,685,491 A * 8/1987 Fulmer et al. ..... 138/31
4,714,094 A * 12/1987 Tovagliaro ..... 138/31
(Continued)

FOREIGN PATENT DOCUMENTS

DE 102009024482 A1 * 12/2010
DE 10 2009 034 804 1/2011
(Continued)

*Primary Examiner* — Thomas Denion
*Assistant Examiner* — Daniel Bernstein
(74) *Attorney, Agent, or Firm* — Davidson, Davidson & Kappel, LLC

(57) ABSTRACT

A pressure accumulator for a camshaft phaser of an internal combustion engine, including a housing that accommodates a piston and forms a cavity fillable with a hydraulic fluid. The cavity is configured as a hole and is closed by a cover on at least one side so as to be fluid-tight, whereby the cover is fastened to the housing by a flanged connection. A method for the production of a pressure accumulator for a camshaft phaser, including a pressure accumulator that forms a cavity, whereby a piston is placed into the cavity, and subsequently, a cover is put in place over the cavity—sealing it off towards the outside—in such a way that a material portion of the housing or of the cover creates such a positive connection between the cover and the housing that the cover is affixed in its position relative to the housing.

16 Claims, 2 Drawing Sheets

(51) Int. Cl.
*F01L 1/46* (2006.01)
*F01L 1/047* (2006.01)

(56) References Cited

U.S. PATENT DOCUMENTS 5,311,910 A * 5/1994 Hasegawa et al. ..... 138/31
5,618,085 A * 4/1997 Siegel et al. ..... 303/113.1
6,203,117 B1 * 3/2001 Starr et al. ..... 303/87
8,316,891 B2 * 11/2012 Koyama ..... 138/31
2008/0283010 A1 11/2008 Bohner et al.
2010/0313560 A1 * 12/2010 Koyama ..... 60/585
2011/0108148 A1 * 5/2011 Crimpita ..... 138/31
2011/0277863 A1 * 11/2011 Ryu et al. ..... 138/31

FOREIGN PATENT DOCUMENTS

DE 10 2010 012 917 4/2011
EP 1 985 813 10/2008
EP 2 267 282 12/2010

* cited by examiner

HOUSING BELL WITH INTEGRATED PRESSURE ACCUMULATOR HAVING A FLANGED COVER

The invention relates to a pressure accumulator for a camshaft phaser of an internal combustion engine, comprising a housing that accommodates a piston and that forms a cavity that can be filled with a hydraulic fluid, such as oil, whereby the cavity is configured as a hole and is closed by a cover on at least one side so as to be fluid-tight.

BACKGROUND

The state of the art discloses camshaft phasers that are employed in internal combustion engines of motor vehicles such as passenger cars or trucks. Such camshaft phasers serve to adjust the ignition timing of the internal combustion engine.

German patent application DE 10 2010 012 917 A1 discloses such a camshaft phaser. This publication especially discloses a camshaft phaser for changing the angular position of a camshaft relative to a crankshaft of an internal combustion engine, whereby the camshaft phaser comprises an actuator and involves the actuation of a hydraulic valve, whereby the actuator is fastened to a housing element by a fastening means. In order to easily produce the actuator and the housing element that supports it and so that the above-mentioned elements are easy to install, the publication proposes that the fastening means be configured as a fastening element that does not have any screws.

Pressure accumulators are also known that assist in supplying hydraulic medium to a camshaft phaser or to a device that is also referred to as a camshaft adjuster. Such a pressure accumulator is known, for example, from German patent application DE 10 2009 034 804 A1. This publication discloses a pressure accumulator that assists in supplying hydraulic medium to a camshaft phaser of an internal combustion engine, comprising a housing, a piston, a coil spring and a guide element, whereby the piston is mounted movably in the housing, whereby moreover, the guide element is arranged in the housing so as to be stationary with respect to it, whereby the guide element has a guiding section and a spring stop, whereby an outer lateral surface of the guiding section is surrounded by the coil spring, whereby the spring stop projects beyond the outer lateral surface of the guiding section in the direction of the inner lateral surface of the housing, whereby furthermore, the coil spring is supported, on the one hand, on the spring stop and, on the other hand, on the piston.

Normally, however, such pressure accumulators are closed by means of a housing with a screwed connection. The cavity containing the piston, the coil spring and a hydraulic fluid such as oil is thus closed by means of the cover that is screwed into the housing.

The presence of threads on the cover in the one hand and in the housing on the other hand calls for a larger installation space in the axial direction. Moreover, screwed connections have a detrimental impact on the time required for installation.

SUMMARY OF THE INVENTION

It is an object of the present invention to reduce the costs associated with a pressure accumulator, to keep the requisite installation space small and to require fewer parts as well as shorter installation times.

The present invention provides that the cover is fastened to the housing by a flanged connection.

The term flanged connection refers to a positive connection created by the displacement of the material of one connection member.

The cover ensures that the pressure accumulator is sealed tightly. The rolled bead should be configured here in such a way that, at the maximum internal pressure, the gap between the cover shoulder and the cover does not become too large, so that the axial pre-tension of an O-ring that might be used falls below the value required to ensure the sealing effect. In the solution according to the invention, it is possible to dispense with a screwed connection between the cover and the housing, which also translates into faster cycle times during production.

Thus, it is advantageous for the flanged connection to bring about a positive connection between the housing and the cover through the displacement of the material of the housing and of the cover.

Particularly in such a configuration, the pressure accumulator can be positioned as close as possible to the camshaft phaser, which is advantageous in order to absorb pressure peaks caused by the adjusting torques that may occur.

It is likewise advantageous for the cover to be immovably mounted on a shoulder of the housing in an axial direction along the longitudinal axis of the hole. The integrity of the pressure accumulator is retained, even after prolonged use of the internal combustion engine.

Another advantageous embodiment is characterized in that a sealing element such as an O-ring, is present between the cover and the housing so as to prevent fluid from escaping from the cavity. Such an O-ring can be made of an elastomer and can be inserted into a groove in the cover and/or in the housing. Particularly with such an embodiment, it is possible to obtain a very tightly sealed pressure accumulator.

The production process is simplified if the hole is configured as a blind hole or if it is closed at both ends by a cover, whereby the cover is preferably installed on the top and/or bottom of the housing.

In order to achieve the flanged connection or the material displacement in an especially simple manner, it is advantageous for the material of the housing to be pulled over the cover for purposes of creating the flanged connection, or for the material of the cover to be displaced out of its original position in order to create the flanged connection.

When the cover is crimped into a groove or over an undercut section of the housing, the pressure accumulator can be sealed tightly with very simple means.

It is likewise advantageous for the flanged connection to be configured radially so as to encircle the entire circumference of the cover, or else to be configured only in certain sections at places that are distributed, preferably evenly, along the circumference, preferably at four places. On the one hand, it is advantageous to simply let a pressurized roller run completely over the circumference of a housing and/or cover in order to create a rolled bead, in contrast to which, on the other hand, applying a flanged connection only at certain points can result in a cheaper configuration of the pressure accumulator.

It is likewise advantageous if a spring such as coil spring, which is in contact, on the one hand, with the piston and, on the other hand, with the bottom of a blind hole, is present in the cavity.

The invention also relates to a camshaft phaser having an oil-supply module containing the pressure accumulator in the above-mentioned manner according to the invention. The housing is then an integral part of the oil-supply module, which is why the number of components can be reduced.

However, the invention also relates to a method for the production of a pressure accumulator for a camshaft phaser. According to the invention, this method is characterized in that a pressure accumulator is present that forms a cavity, whereby a piston is placed into the cavity, and subsequently, a cover is put in place over the cavity—sealing it off towards the outside—in such a way that a material portion of the housing or of the cover creates such a positive connection between the cover and the housing that the cover is affixed in its position relative to the housing.

BRIEF DESCRIPTION OF THE DRAWINGS

The invention will be described below in greater detail with reference to a drawing in which the following is shown.

DETAILED DESCRIPTION

Figure 1:
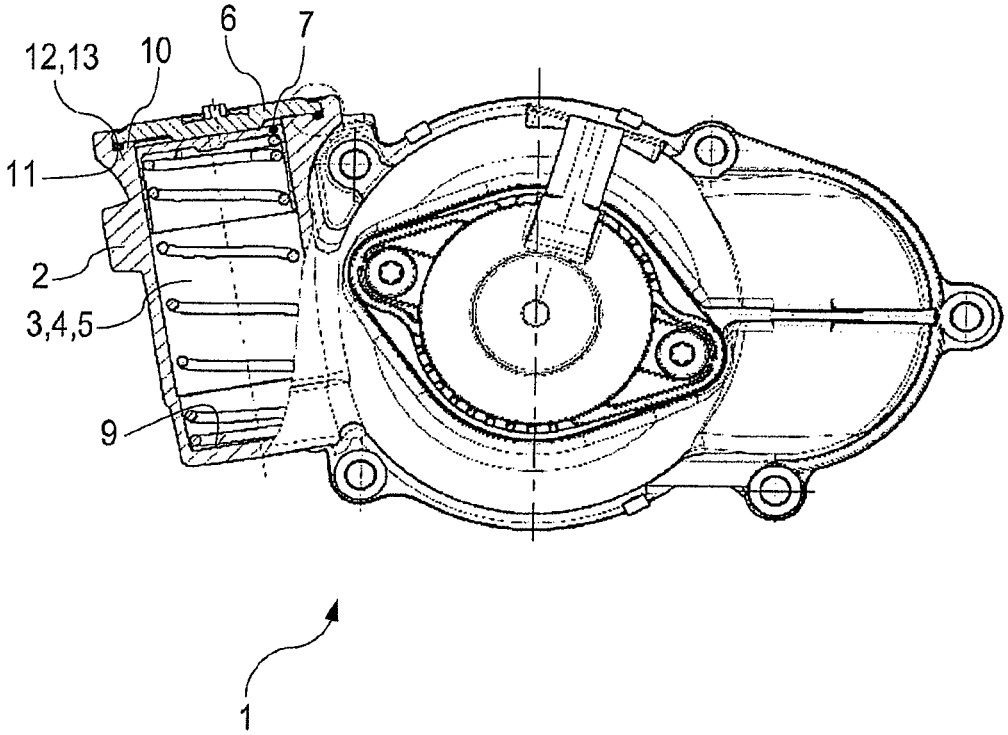
FIG. 1 a front view of a pressure accumulator according to the invention, in a partially cutaway depiction.

The figures are merely of a schematic nature and serve only to explain the invention. Identical elements are designated by the same reference numerals.

FIG. 1 shows a first embodiment of a pressure accumulator 1 according to the invention. The pressure accumulator 1 is part of a camshaft phaser which, in turn, is part of an internal combustion engine. The pressure accumulator 1 has a housing 2 that forms a cavity 3 in the form of a hole 4, especially in the form of a blind hole 5. The cavity 3 is closed with a cover 6.

At the end of the cavity 3 on the cover side, there is a piston 7 which is mounted movably and in contact with a spring 8. The spring 8 is supported on the inside of the piston 7 and on the bottom 9 of the cavity 3. The cover 6 rests on a shoulder 10 of the housing, whereby a groove 11 is created between the housing 2 and the cover 6, and a sealing element 12, namely, an O-ring 13, is inserted into said groove 11.

The cover 6 has a centering bushing 14 and a piston stop 15 on the opposite side. This can be seen particularly well in FIG. 3.

Figure 2:
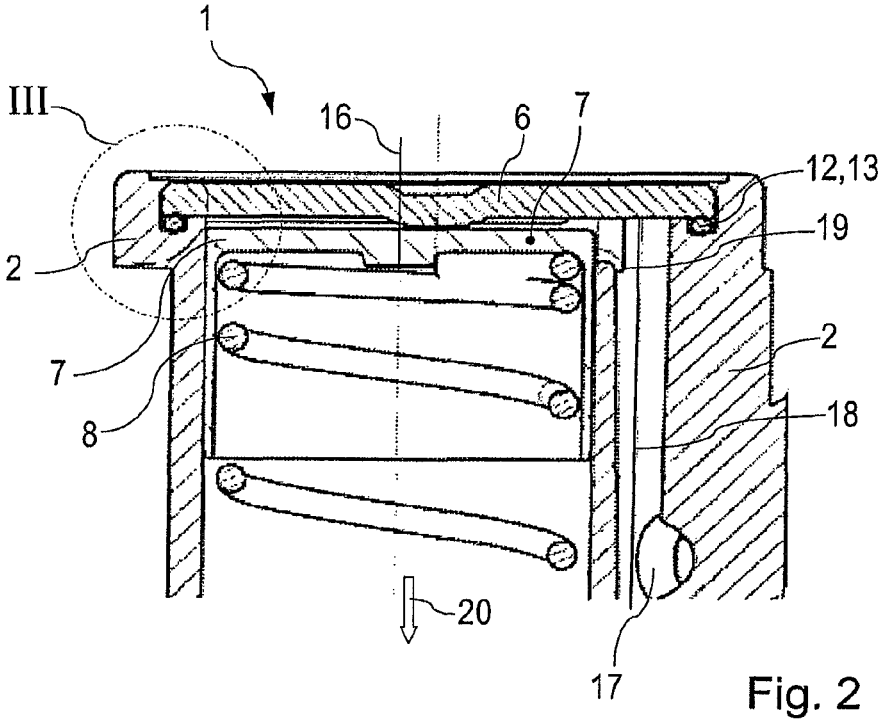
FIG. 2 a section from FIG. 1 in an enlarged sectional view.
Figure 3:
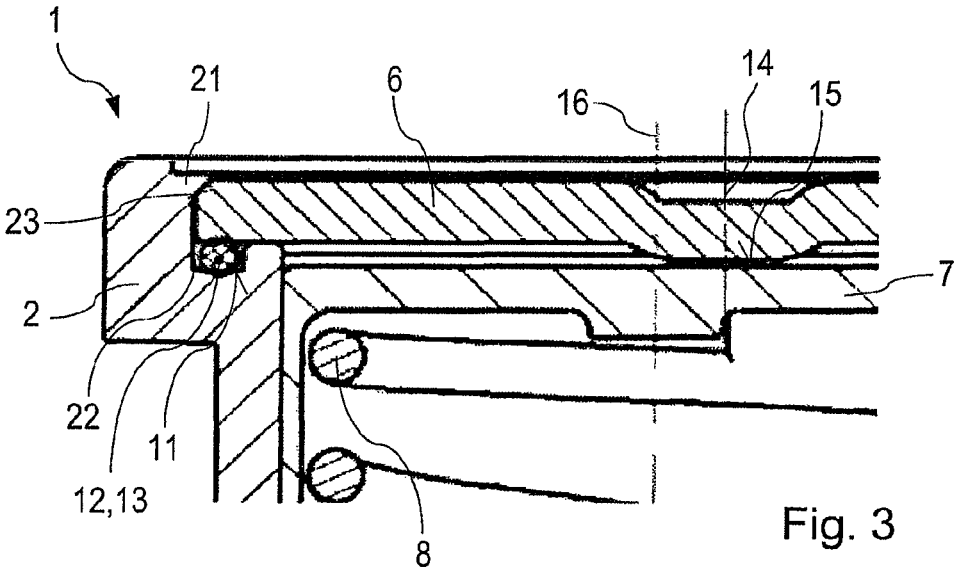
FIG. 3 another enlarged sectional view of the embodiment from FIGS. 1 and 2 in the area of the cover of the pressure accumulator.

FIGS. 1 to 3 also depict the longitudinal axis 4 of the hole, which is designated by the reference numeral 16.

FIG. 2 shows an oil-feed opening 17 that makes a transition into a riser section 18. The riser section 18 allows oil to be fed via an edge 19 into the cavity 3, a process in which it pushes the piston 7 in the direction shown by the arrow 20. The piston 7 then acts against the force of the spring 8, which is configured as a coil spring.

On the outside of the cover 6, the material displacement brought about, for example, by using a flanging or rolling tool, creates a projection 21 in the form of a rolled bead. The pressure-application area needed for the displacement of the material is likewise present in the area of the projection 21. If there is sufficient radial play between the cover 6 and the housing 2, material from the housing 2 is pressed into a very small gap 22 that is present between these two elements.

It should be pointed out that the material displacement presupposes that either the housing 2 or the cover 6 can be deformed, or else that even both of these elements can be deformed in such a way that material is displaced. The material displacement causes the material constituents to flow.

A cutout is present on the outside of the cover 6. This cutout is designated by the reference numeral 23. The material of the cover is preferably the same as that of the housing in order to prevent thermal gaps between the cover 6 and the housing 2 in the radial direction. An aluminum alloy has been used in the present embodiment. The centering bushing 14 on the cover 6 facilitates the rolling process, in contrast to which the cutout 23 on the cover 6 can be used to receive the housing material that was displaced by the flanging process. The piston stop 15 on the cover 6 prevents adhesion between the piston 7—which can also be referred to as a piston slide—and the cover 6.

LIST OF REFERENCE NUMERALS

1 pressure accumulator
2 housing
3 cavity
4 hole
5 blind hole
6 cover
7 piston
8 spring
9 bottom
10 shoulder
11 groove
12 sealing element
13 O-ring
14 centering bushing
15 piston stop
16 longitudinal axis of the hole
17 oil feed opening
18 riser section
19 edge
20 arrow
21 projection
22 gap
23 cutout

What is claimed is:

1. A pressure accumulator for a camshaft phaser of an internal combustion engine, comprising:

a housing accommodating a piston and forming a cavity fillable with a hydraulic fluid, the cavity being configured as a hole; and a plate-shaped cover closing the hole on at least one side so as to be fluid-tight, the cover being fastened to the housing by a flanged connection, the cover being immovably mounted on a shoulder of the housing in an axial direction along the longitudinal axis of the hole the cover including an inner axial surface contacting the piston, the inner axial surface including a flat portion contacting a shoulder of the housing and a piston stop axially offset from the flat portion contacting the piston.

2. The pressure accumulator as recited in claim 1 wherein the flanged connection creates a positive connection between the housing and the cover through the displacement of material of at least one of the housing and of the cover.

3. The pressure accumulator as recited in claim 1 further comprising a seal between the cover and the housing to prevent fluid from escaping from the cavity.

4. The pressure accumulator as recited in claim 3 wherein the seal is an O-ring.

5. The pressure accumulator as recited in claim 1 wherein the hole is configured as a blind hole or is closed at both ends by the cover.

6. The pressure accumulator as recited in claim 5 wherein the cover is installed on at least one of a top and a bottom of the housing.

7. The pressure accumulator as recited in claim 1 wherein a material of the housing is pulled over the cover for purposes of creating the flanged connection, or the material of the cover is displaced out of an original position in order to create the flanged connection.

8. The pressure accumulator as recited in claim 7 wherein the cover is crimped into a groove or over an undercut section of the housing.

9. The pressure accumulator as recited in claim 1 wherein the flanged connection is configured radially so as to encircle the entire circumference of the cover, or else configured only in certain sections at places distributed along the circumference.

10. The pressure accumulator as recited in claim 9 wherein the places are distributed evenly.

11. The pressure accumulator as recited in claim 9 wherein the places number four.

12. The pressure accumulator as recited in claim 1 wherein the hydraulic fluid is oil.

13. A camshaft phaser comprising an oil-supply module containing the pressure accumulator as recited in claim 1.

14. The pressure accumulator as recited in claim 1 wherein the housing includes a groove radially outside of the shoulder holding a seal therein.

15. The pressure accumulator as recited in claim 14 wherein the cover includes a flat inner axial surface facing the piston, the flat inner axial surface contacting the shoulder and the seal.

16. The pressure accumulator as recited in claim 1 wherein the housing includes an oil-feed opening transitioning into a riser section that allows oil to be fed via an edge into the cavity to push the piston away from the cover.

* * * * *